United States Patent [19]

Takahashi et al.

[11] Patent Number: 4,844,783

[45] Date of Patent: Jul. 4, 1989

[54] METHOD FOR ELECTRODEPOSITION COATING

[75] Inventors: Yoshinobu Takahashi; Ikukazu Hibino; Takanobu Mori; Kentaro Ogata, all of Toyota, Japan

[73] Assignee: Toyota Jidosha Kabushiki Kaisha, Aichi, Japan

[21] Appl. No.: 74,976

[22] Filed: Jul. 17, 1987

[30] Foreign Application Priority Data

Jul. 22, 1986 [JP] Japan ..... 61-170890

[51] Int. Cl.[4] ..... C25D 13/00; B65G 49/00

[52] U.S. Cl. ..... 204/180.2; 204/299 EC; 204/300 EC

[58] Field of Search ..... 204/299 EC, 300 EC, 204/180.2, 180.9

[56] References Cited

U.S. PATENT DOCUMENTS

| | | | |
|---|---|---|---|
| 3,355,374 | 11/1967 | Brewer et al. | 204/181 |
| 3,728,242 | 4/1973 | Loop et al. | 204/181 |
| 4,486,284 | 12/1984 | Mori et al. | 204/181 |

FOREIGN PATENT DOCUMENTS

| | | | |
|---|---|---|---|
| 2935061A1 | 8/1979 | Fed. Rep. of Germany . | |
| 46-2757 | 1/1971 | Japan | 204/300 EC |
| 51-4307 | 2/1976 | Japan . | |
| 54-112949 | 9/1979 | Japan . | |
| 56-156798 | 3/1980 | Japan . | |
| 58-701 | 1/1983 | Japan . | |
| 58-4928 | 1/1983 | Japan . | |
| 58-10476 | 2/1983 | Japan . | |
| 58-93894 | 3/1983 | Japan . | |
| 59-177398 | 8/1984 | Japan . | |

OTHER PUBLICATIONS

Metal Finishing, G. E. F. Brewer, Sep. 1980, pp. 55–59.

*Primary Examiner*—John F. Niebling
*Assistant Examiner*—Ben C. Hsing
*Attorney, Agent, or Firm*—Finnegan, Henderson, Farabow, Garrett and Dunner

[57] ABSTRACT

A method for the electrodeposition coating of workpieces conveyed in an electrodeposition bath, wherein voltage applying means is provided in a plurality of stages of not less than three in the conveying direction of the workpieces. Voltage is increased at the first stage, and the multiple stages voltage applying means is initiated after the workpieces reach a submersion area where the workpieces are completely submerged in the paint contained in the electrodeposition bath. Voltage application at the final stage of the voltage applying means is terminated before the workpieces exit from the submersion area. By this method, the thickness of the electrodeposition film can be made uniform so that there is no difference in film thickness between lower and higher workpieces or in the lower and upper parts of a workpiece.

10 Claims, 5 Drawing Sheets

METHOD FOR ELECTRODEPOSITION COATING

BACKGROUND OF THE INVENTION

1. Field of the Invention

The present invention relates to coating metallic workpieces by electrodeposition; coating of vehicle parts, etc.; and more specifically to a method of providing a uniform film in coating workpieces by electrodeposition coating.

2. Description of the Prior Art

Conventional methods for applying by electrodeposition a coating to a plurality of workpieces being conveyed in a continuous process typically call for placing electrode plates at both the right and left sides or, as the case may be, at the bottom of an electrodeposition bath that contains the paint, bringing in the workpieces to be coated from one side of the electrodeposition bath into the paint, while applying direct current voltage between the workpieces and the electrode plates; and bringing out the workpieces from the other side of the electrodeposition bath. (For examples, JP-B-SHO 58-10476, JP-A-SHO 54-112949 and Japanese Utility Model Publication SHO 58-701)

Such a conventional method for electrodeposition coating, however, presents a problem in that it creates an uneven thickness electrodeposition film of between the workpieces, particularly when the workpieces to be coated are relatively small; for instance, in cases where workpieces are smaller than a vehicle body, such as vehicle parts. For the purpose of improving production efficiency, typically a plurality of workpieces are vertically hung from a conveying means (for example, a suspension hanger), and conveyed in such a configuration through the electrodeposition bath. (For example, Japanese Utility Model Publication SHO 58-701 and Japanese Utility Model Publication SHO 58-4928) When utilizing such a conveying method, among the vertically hung workpieces, the workpiece in the lower position is immersed in the paint contained in the electrodeposition bath first, while the workpiece in the upper position comes out of the paint first. Therefore, the length of time that the workpieces in the lower position stay in the paint, and the length of time that the current flows to the workpieces in the lower position, is longer than that for the workpieces in the upper position; thus, as a consequence, the electrodeposition film on the workpieces in the lower position is thicker than that on the workpieces in the upper position. Such irregularity or non-uniformity in the thickness of an electrodeposition film occurs, also, in case of a large workpiece, such as the body of a vehicle, where the coating on the lower part of the workpiece is apt to be thicker than that on the upper part.

Thicker electrodeposition film may be advantageous, from the rust resistance point of view, in case of the chassis parts of a vehicle, including driving operation parts and engine supporting parts. However, if the thickness of the electrodeposition film on the workpieces reaches the range between 30 μm and 45 μm, such disadvantages as loosened bolts, caused by deformation of the paint film due to fatigue; and the necessity of increasing clamping torque at the screwing part of the nuts can be expected.

It is deemed possible to apply conventional methods; which have been disclosed as solutions to such problems, such as abnormal adhesion of paint at the time of entrance into the bath, or miscoating of paint causing such defects as pinholes, etc; in order to reduce uneveness or non-uniformity in the thickness of the electrodeposition films between lower and upper workpieces or between the lower and upper parts of a workpiece. Such methods, however, are not in themselves intended to reduce irregularities in the thickness of electrodeposition films. Included in such known methods are 2-stage power conduction system, which calls for applying low voltage at the time of entrance into the bath; and then applying a predetermined high voltage once immersion is completed (JP-A-SHO 58-93894: U.S. Pat No. 4,486,284); and the method which calls for removing the electrode plates at the entrance side of the electrodeposition bath (JP-A-SHO 54-112949). In addition to the above, the method which calls for a shielding plate made of insulating material to be placed on the side of the electrode plate facing the workpiece to be coated at the entrance side of the bath so as to restrain sudden influx of a large amount of current (Japanese Utility Model Publication SHO 51-4307).

Further, JP-A-SHO 59-177398 discloses a method for detecting the position of a workpiece when it has become completely immersed in the paint upon entering the bath, so as to start applying voltage and for detecting the position of the workpiece when the workpiece starts to come out of the bath so as to stop applying voltage. In this manner, workpieces are electrodepositedly coated only in the area where the workpieces are completely immersed, thus essentially preventing the problem of irregularities of the electrodeposition film thickness between the upper and the lower workpieces and/or between the upper and lower parts of the workpiece.

However, the methods disclosed in the above-mentioned JP-A-SHO 58-93894 (U.S. Pat. No. 4,486,284), JP-A-SHO 54-112949 and Japanese Utility Model Publication SHO 51-4307 reduce to some extent differences in the thickness of electrodeposition films incurred at the entrance side of the bath, but are not sufficient to prevent such differences in thickness of films of the lower and upper workpieces at the exit side of the bath, because the voltage is still applied, thus continuing electrodeposition coating, for the period from when the workpiece in the upper position starts to emerge from the paint to the time all the workpieces have completely emerged.

According to the method disclosed in JP-A-SHO 59-177398, an electrodeposition coating is impressed by a single means of voltage application to the workpieces in a submersion area (an area of a bath where a conveyed workpiece is completely submerged in the paint). Therefore, no problem should occur as long as only one workpiece or one vertical line of a plurality of workpieces is present in the submersion area at one time, but if a plurality of workpieces are to be continuously conveyed in short intervals, thus resulting in the presence of multiple workpieces on the conveying route at the same time in the submersion area, the following problem is evident. When a workpiece emerges from the electrodeposition bath, voltage application to the workpiece is suspended for the length of time when the workpiece starts to emerge until the workpiece completely emerges from the paint; but the suspension of the voltage application also affects the succeeding workpieces, which are still in the paint, as there is only one voltage applying means.

As a result electrodeposition coating time for the succeeding workpieces is insufficient, thus bringing about the unfavorable consequence of insufficient thickness of film. Further, since the bus bars are one portion of the means of applying the voltage with a fixed electrical potential along the full length of the conveying route of the workpieces, contact by the brush, which is conveyed together with the workpiece, with the beginning of the bus bar will generate a sudden flow of a large amount of electric current. Such sudden current flow will generate sparks and initiate electrodeposition coating that may cause defects on the electrodeposition film such as rash, pinholes, etc.

SUMMARY OF THE INVENTION

An object of the present invention is to provide a uniform thickness of electrodeposition film on workpieces which are continuously conveyed and electrodepositedly coated; specifically, to eliminate difference in film thickness between lower and upper workpieces and/or the lower and upper parts of a workpiece.

Another object of the present invention is to provide an electrodeposition film of a predetermined uniform thickness to each and every workpiece of a plurality of workpieces simultaneously submerged while being conveyed, in a submersion area of an electrodeposition bath, by supplying each of the workpieces with the same condition and period of voltage application.

A further object of the present invention is to provide a method for gradually boosting the voltage at the time of the initiation of voltage application, while maintaining the specified condition of current application to the workpieces in the submersion area, in order to prevent sparks and defects on the electrodeposition films such as rash, pinholes, etc.

To accomplish the above objects, in a method for electrodeposition coating according to the present invention, the process for electrodeposition coating proceeds as follows. When a plurality of workpieces call for electrodeposition coating, and the workpieces are positioned along the conveying route and continuously conveyed by conveying means through an electrodeposition bath containing paint and equipped with voltage applying means having bus bars and electrode plates, the voltage applying means are positioned in three or more stages along the conveying route in a submersion area of the bath, where the workpieces are completely submerged in the paint contained therein; and after the conveyed workpieces reach the submersion area, boosting of voltage is initiated at the first stage of the multiple-staged voltage applying means, and before the workpieces have emerged from the submersion area, the application of voltage at the final stage of the multiple-staged voltage applying means is terminated.

According to this method, voltage is applied to the workpieces to be coated, in sequence by voltage applying means consisting of three or more stages, while the workpieces are completely immersed in the submersion area of the electrodeposition bath. Since the voltage application by the first stage is initiated only after the workpiece to be coated has entered the submersion area, electrodeposition coating is initiated simultaneously and under the same condition to workpieces located in the upper or lower positions or the upper or lower portions of a workpiece, thus solving the problems of non-uniform thickness of the electrodeposition films on the higher and lower positioned workpieces; or the upper and lower parts of the workpiece, which would otherwise occur at the time of entering the bath. As voltage is gradually boosted after the workpiece has reached the first voltage applying means, there will be no occurrence of sparks due to a sudden flow of massive electric current at the beginning of the bus bar, and rash and pinholes on the film can also be prevented. The voltage is boosted to the specified level by the first voltage applying means; and by the time the following workpiece reaches the first voltage applying means, where voltage is applied to the following workpiece, the first workpiece will already have been conveyed to the second voltage applying means. Therefore, voltage application to the preceding workpiece at a predetermined level is not affected by voltage application to the following workpiece. The same procedure of boosting is repeated to the following workpieces.

When the workpiece has reached the final stage of the voltage applying means, the voltage application at the final stage is terminated, thus ending electrodeposition coating, before the workpiece emerges from the submersion area. At that time, however, voltage application to the following workpiece at the specified level continues, because the following workpiece has not yet reached the final stage of voltage applying means. It is only the final stage of voltage applying means, where voltage application is terminated. The workpiece is conveyed out of the submersion area, and no voltage is applied while the workpiece is being conveyed out of the bath. Thus, different thicknesses of electrodeposition films between lower and upper workpieces are avoided.

In the manner as described above, first, after the workpieces to be coated enter the submersion area, power is gradually boosted to the specified voltage by the first voltage applying means; next, the specified voltage is continuously applied to the workpieces by the second voltage applying means without being affected by the voltage boosting of the previous first voltage applying means, or by the termination of voltage application of the subsequent final voltage applying means; and finally the voltage application to the workpieces by the final voltage application means is terminated while the workpieces are in the position of the final voltage applying means. As a result each and every workpiece can receive voltage application under the same condition and for the same length of time; and, therefore, the same specified thickness of electrodeposition coating film can be achieved, even if the workpieces are conveyed continuously, and even if a plurality of workpieces exist in the submersion area at the same time. Furthermore, because voltage is not applied to the workpieces at the time of entering or emerging from the electrodeposition bath but only in the submersion area, the thickness of electrodeposition film is uniform regardless of the vertical position of the workpieces or the vertical location on a workpiece.

BRIEF DESCRIPTION OF THE DRAWINGS

The accompanying drawings, which are incorporated in and constitute a part of this specification, illustrate several embodiments of the invention and together with the description serve to explain the principles of the invention.

DETAILED DESCRIPTION OF THE PREFERRED EMBODIMENTS

Figure 1:
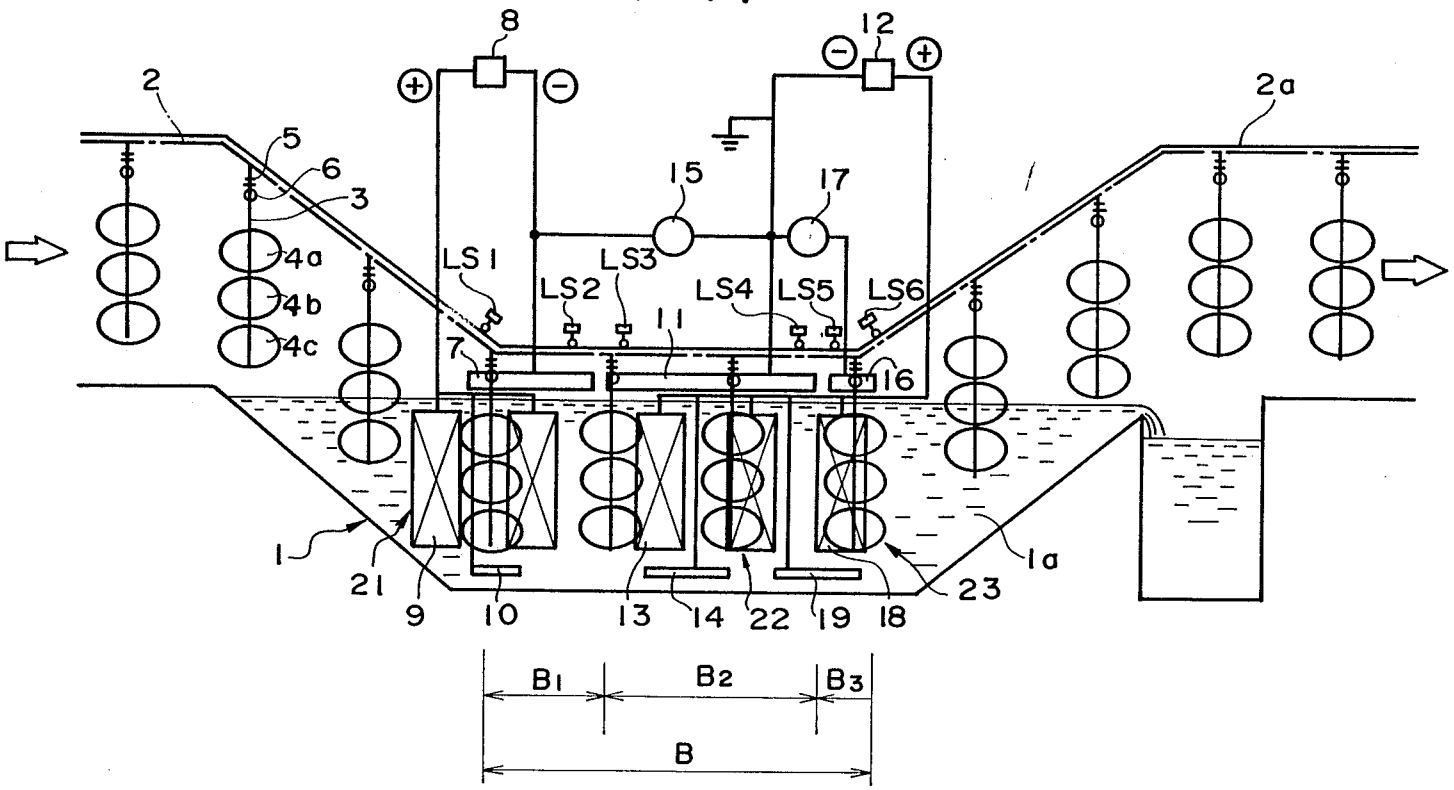
FIG. 1 is a schematic side view of an electrodeposition coating apparatus to be used in a method for electrodeposition coating according to a first embodiment of the present invention.

The illustrated preferred embodiments of the present invention will be described hereunder referring to the attached drawings wherein like reference numerals refer to similar parts;

First Embodiment

Figure 2:
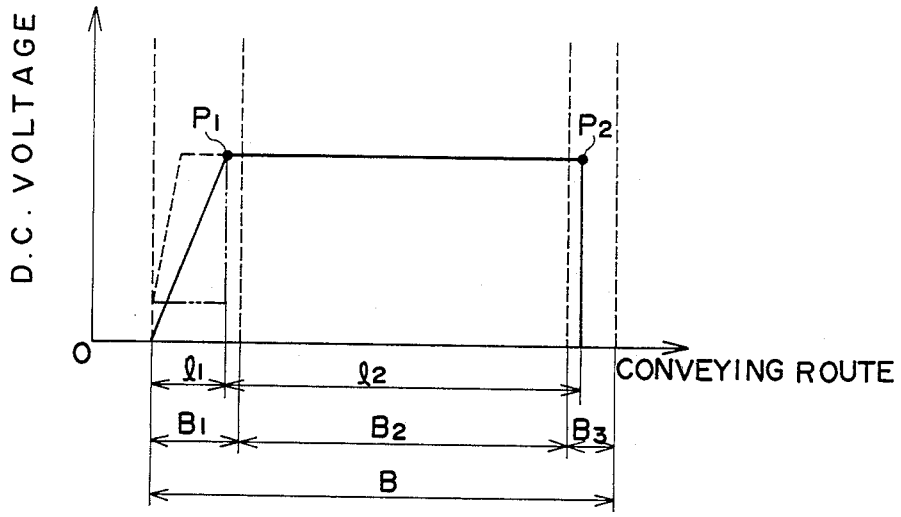
FIG. 2 is a graph showing the relationship between the position of a workpiece being conveyed and direct current voltage to be applied, in the apparatus shown in FIG. 1.

FIG. 1 shows an apparatus to be used for a method of electrodeposition coating according to a first embodiment of the present invention. FIG. 2 shows a pattern of voltage application in the apparatus. In FIG. 1 numeral 1 shows an electrodeposition bath filled with paint 1*a*. Workpieces 4*a*, 4*b* and 4*c* to be coated are vertically arranged and hung from a hanger 3. Hanger 3 is connected to a conveyor 2 through insulator 5, and the hanger 3 is run along guiderail 2*a*. A plurality of workpieces 4*a*, 4*b* and 4*c* are hung from hanger 3 in plurality and conveyed in succession along the conveying route. At the upper end of hanger 3 brush (otherwise called collector) 6 is attached, so as to come into contact with bus bars of the voltage applying means. In this embodiment, the voltage applying means installed at the electrodeposition bath 1 is located at the submersion area B, in which area the workpieces 4*a*, 4*b* and 4*c* are completely submerged in the paint, and consists of voltage applying means 21, 22 and 23 constituting three stages indicated as B1, B2 and B3 along the route of conveying the workpieces. Each and every voltage applying means 21, 22 and 23 are equipped with positive electrode plates 9, 13 and 18 at the left and right side in the bath 1, positive electrode plates (or positive poles as the case may be) 10, 14 and 19 facing the bottom of the bath 1, and with bus bars 7, 11 and 16 as negative electrode side.

Workpieces 4*a*, 4*b* and 4*c* are conveyed by conveyor 2 along the guiderail 2*a* and start to enter the electrodeposition bath 1. When workpieces 4*a*, 4*b* and 4*c* reach the submersion area B, the position of the workpieces is detected by a limit switch LS1; and in response to detection by the limit switch, voltage application to the workpieces is initiated. Current is supplied to the workpieces 4*a*, 4*b* and 4*c* by the bus bar 7 of the first voltage applying means 21 through the brush 6 from the negative electrode side of a first rectifier 8 (a direct current generator). The positive electrode side of the first rectifier 8 is connected through cables to the positive electrode plates 9 at the left and right sides in the electrodeposition bath and positive electrode plates 10 facing the bottom of the electrodeposition bath. In this manner, direct current voltage is applied to the area B1 between the workpieces 4*a*, 4*b* and 4*c* and the positive electrode plates 9 and 10, thus the electrodeposition coating is applied.

In the area B1, voltage applied by the first voltage applying means 21 is increased in the boosting area l1 in the pattern as shown in FIG. 2. In other words, boosting is initiated upon signal from the limit switch LS1, and voltage is boosted in a straight line from zero to a specified voltage (indicated as point P1). This boosting pattern may be a more rapid boosting pattern indicated as a broken line or a step-like pattern, as indicated in a 2-point chain line, wherein boosting is slowed for a certain length of time, or, may be any other pattern, such as, for example, a curved line. As the function of the apparatus is not affected by the patterns of voltage boosting, preferred patterns may be determined while observing the quality of electrodeposition films.

Since boosting is initiated after the brush 6 is electrically connected to the bus bar 7 of the first voltage applying means 21, there is no generation of spark when the brush 6 starts to contact the bus bar 7. Further, as voltage to be applied to the workpieces 4*a*, 4*b* and 4*c* is gradually boosted after the workpieces 4*a*, 4*b* and 4*c* have completely entered the submersion area B, there is no sudden flow of massive electric current between the workpieces 4*a*, 4*b* and 4*c* and the positive electrode plates 9 and 10, nor will rash, pinholes, etc. occur on electrodeposition film at this stage of electrodeposition coating. Furthermore, as voltage is applied after the workpieces 4*a*, 4*b* and 4*c* all enter the submersion area B, there is no difference in thickness of electrodeposition film on vertically arranged workpieces 4*a*, 4*b* and 4*c*, in contrast to non-uniformity which may otherwise occur when voltage is applied while entering the bath.

When the workpieces 4*a*, 4*b* and 4*c* are conveyed to the end of or near the end of the first voltage applying means 21, their position is detected by a limit switch LS2. Then, the brush 6 is transferred from the bus bar 7 to the bus bar 11 of the second voltage applying means 22, and at the time of this transfer sparks will be generated unless electric potential of the bus bar 7 is identical to that of bus bar 11 connected to the negative electrode side of a second rectifier 12. For this reason, upon signal from the limit switch LS2, the bus bar 7 and the bus bar 11 become electrically connected through a connector 15 so as to make their electric potential identical, and sparks will not be generated when the brush 6 is transferred. When the brush 6 has been transferred to the bus bar 11, the position of the transferred brush 6 is detected by a limit switch LS3, and upon the detection signal connection through the connector 15 is disconnected, and current to the bus bar 11 is supplied from the second rectifier 12. Voltage application for electrodeposition coating is not interrupted at the time of this brush transfer, because brush 6 is so configurated as to allow electrical connection thereof simultaneously to both bus bars 7 and 11. Further, as the area B1, where power is supplied from the rectifier 8, is set narrower than the pitch of the hanger 3 (in other words the pitch of the brush 6), it is always after preceding workpieces 4*a*, 4*b* and 4*c* enter the area B2, where power is supplied from the second rectifier 12, that succeeding workpieces 4*a*, 4*b* and 4*c* enter the power supplying area B1, where the same procedure of voltage boosting as described above is repeated. Thus, voltage application to the workpieces 4*a*, 4*b* and 4*c*, which are in the power supplying area B2, is not at all affected by boosting control in power supplying area B1. As a consequence, the preceding workpieces 4a, 4b and 4c and the succeeding workpieces 4a, 4b and 4c receive voltage application of an identical amount under exactly the same condition.

In the area B2 the workpieces 4a, 4b and 4c are continually applied electrodeposition coating with constant voltage application from the second rectifier 12. When the workpieces 4a, 4b and 4c reach or come near the end terminal of the second voltage applying means 22, their position is detected by a limit switch LS4. Upon signal from the limit switch LS4, power is supplied from the second rectifier 12 through the connector 17 to the bus bar 16 of the final voltage applying means 23. In this state the brush 6 transfers from the bus bar 11 to the bus bar 16.

When the workpieces 4a, 4b and 4c have completely transferred to the final voltage applying means 23, their position is detected by a limit switch LS5, and upon signal thereof connection through the connector 17 is broken, and voltage application to the workpieces 4a, 4b and 4c is terminated in the submersion area B (Point P2 in FIG. 2). When the workpieces 4a, 4b and 4c are conveyed further, a limit switch LS6 detects that the brush 6 has left the bus bar 16, and upon signal thereof the connector 17 is either re-connected or becomes ready to be re-connected.

Thus it is only at the final voltage applying means 23 that voltage application stops once workpieces 4a, 4b and 4c have transferred to the final voltage applying means 23 and, therefore, the termination of voltage application does not produce any effect on voltage application to succeeding workpieces 4a, 4b and 4c, which are in the area B2. For this reason the preceding workpieces 4a, 4b and 4c and the succeeding workpieces 4a, 4b and 4c will have identical voltage application factors also from the area B into the area C and, after all, the same voltage application factors throughout the submersion area B; i.e. boosted in the area 11 and maintained at a specified voltage in the area 12 until termination of voltage application. As the result, the desired thickness of electrodeposition film is formed on each and every workpiece conveyed continuously, regardless of their order of conveyance. Further, as power supply to the bus bar 16 is already terminated when the brush 6 leaves the bus bar 16, there can be of course no generation of sparks. Furthermore, there will be no non-uniformity in the thickness of coating on workpieces 4a, 4b and 4c which would otherwise be caused by emergence from the electrodeposition bath, because voltage application by the final voltage applying means 23 is terminated while vertically arranged workpieces 4a, 4b and 4c are in the area B3, and after this termination of voltage application the workpieces are brought out of the bath. The following illustrates an example of the apparatus according to the present invention and results thereof.

EXAMPLE

The size of the electrodeposition bath 1 in this example is 2500 mm wide from the left side to the right side and 28000 mm long along the conveying route, the pitch of the hanger 3 is 1200 mm, and vehicle parts are used for workpieces to be coated 4a, 4b and 4c. The workpieces 4a, 4b and 4c are hung by the hanger 3, and the workpieces are arranged in an area of 1000 mm long, 1200 mm wide and 1400 mm high. At the points where the workpieces enter and emerge from the bath 1, the angle of the guiderail 2a for the conveyor is 20° off the horizontal. For electrode plates, diaphragm electrodes are used for those facing the sides of the bath and bare electrodes facing the bottom of the bath. The conditions of electrodeposition coating at the electrodeposition bath 1 are as follows:

| | |
|---|---|
| Paint | Paint for cathodic electrodeposition coating |
| Concentraition of paint | 19–21% |
| Temperature of paint | 26–28° C. |
| Coating voltage | First rectifier; 0 V–280 V/30 sec.<br>Second rectifier; 280 V fixed |
| Total current | First rectifier; 0–150 A<br>Second rectifier; 350 A |
| Conveying speed | 2.5 m/min. |

As the result, the desirable thickness of the outside electrodeposition film was obtained, as well as good deposition condition on the inside, with the thickness of electrodeposition film on the outside being 35 μm–40 μm and on the inside 26 μm–30 μm. Film surface was smooth and in satisfactory condition. Further, there was no generation of spark.

COMPARISON

Figure 4:
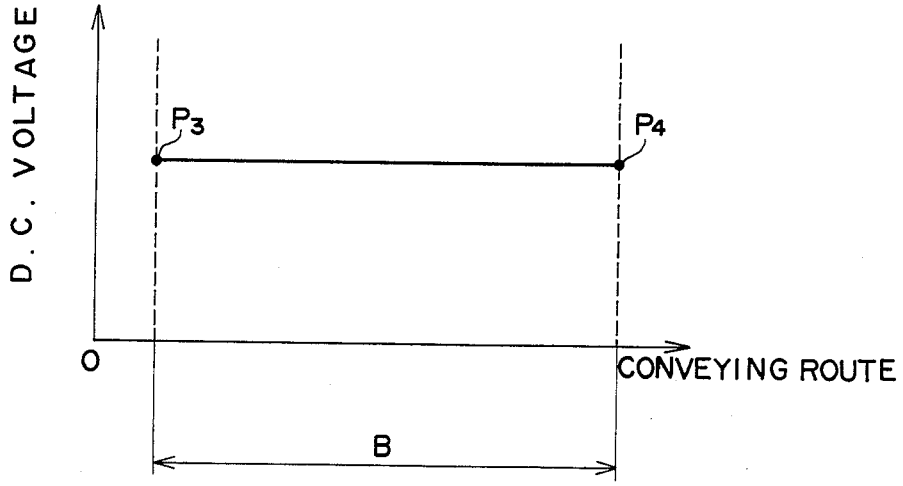
FIG. 4 is a graph showing the relationship between conveying position and direct current voltage to be applied, in the apparatus shown in FIG. 3.
Figure 3:
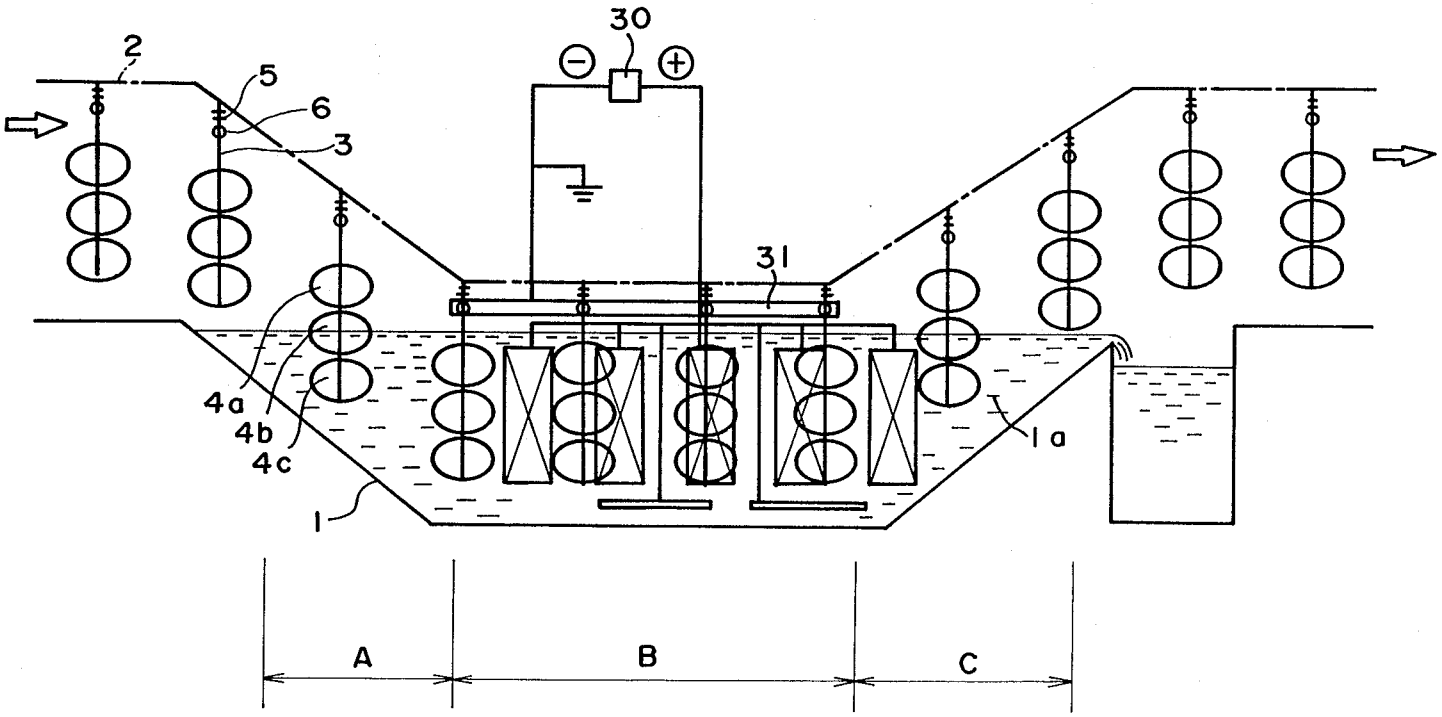
FIG. 3 is a schematic side view of a single stage electrodeposition coating apparatus illustrated for comparison purposes.

Next, an example according to the conventional method is shown in FIG. 3 and FIG. 4 for the purpose of comparison with the present invention. In this comparison, voltage is applied by a single common rectifier 30, and bus bar 31 is formed in a form of one continual bus bar over the total length of the submersion area B. Other components of the comparison correspond to the composition shown in FIG. 1, so the parts and materials which can be regarded as the same as those in FIG. 1 have the same references as FIG. 1.

In the comparison, the workpieces to be coated 4a, 4b and 4c enter the electrodeposition bath 1 in the area A and through the submersion area B and emerge from the bath 1 in the area C. Bus bar 31, which is connected to the negative electrode side of rectifier 30, is of identical length to the submersion area B so that brush 6 is connected to the bus bar 31 at the starting point of the submersion area B and leaves the bus bar 31 at the terminating point thereof. Therefore, current is applied to workpieces 4a, 4b and 4c only in the submersion area B, thus being electro-depositionally coated only while they are fully submerged in the paint, also as in the method of the present comparison.

As the voltage applying means consists of only one stage, however, DC voltage application in this method forms the pattern shown in FIG. 4; voltage is fixed from the starting point of voltage application P3 to the terminating point of voltage application P4. According to the method of this comparison, a sudden flow of massive electric current is inevitable at the starting point of voltage application P3, when the brush 6 contacts the bus bar 31. As the result, sparks were generated when current was supplied at the start. Also, due to the sudden flow of massive electric current, electrodeposition film obtained at the start of electrodeposition coating was flawed by rashes, pinholes and the like. Moreover, sparks were generated at the terminating point P4 of voltage application, when the brush 6 left the bus bar 31, because the bus bar 31 was still being supplied with current at that point.

Second Embodiment

Figure 5:
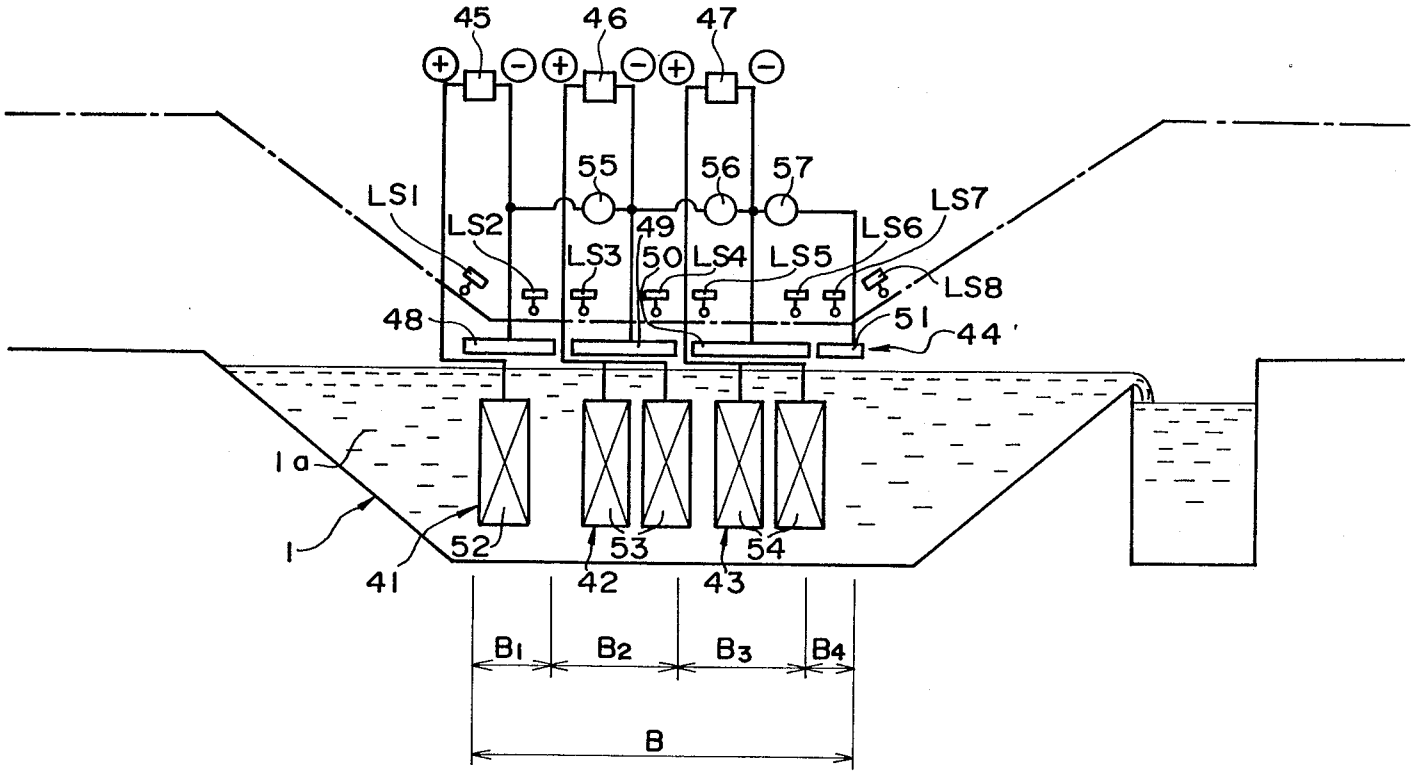
FIG. 5 is a schematic side view of an electrodeposition coating apparatus to be used in a method for electrodeposition coating according to a second embodiment of the present invention.
Figure 6:
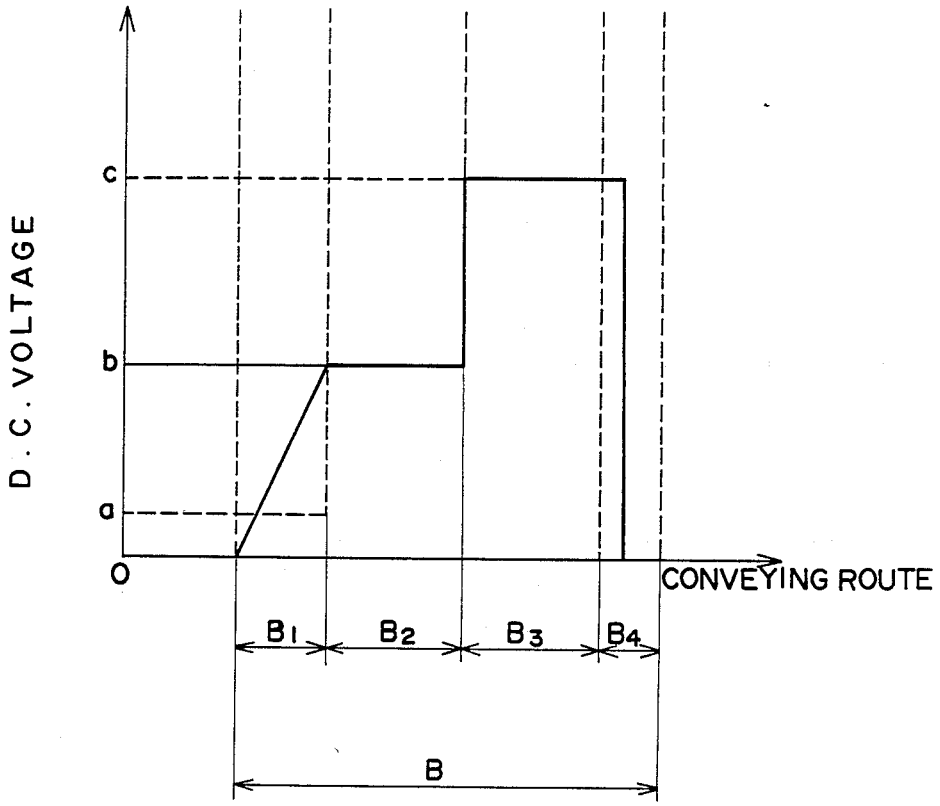
FIG. 6 is a graph showing the relationship between the position of a workpiece being conveyed and direct current voltage to be applied, in the apparatus shown in FIG. 5.

Second embodiment of the present invention is illustrated in FIG. 5 and FIG. 6. In this embodiment voltage applying means consists of four stages 41, 42, 43 and 44, including the first voltage applying means 41 and the final voltage applying means 44. The submersion area B comprises area B1, where current is supplied by the first rectifier 45, area B2, where current is supplied by the second rectifier 46, area B3, where current is supplied by the third rectifier 47, and area B4 for the final voltage applying means 44. Limit switch LS1 shown in FIG. 5 is to detect the position of a workpiece (not shown) when the workpiece reaches the submersion area B, each limit switch LS2, LS3, LS4, LS5 and LS6 is to detect the transfer position of the brush, limit switch LS7 is to detect the termination point of current supply and limit switch LS8 is to detect that the brush (not shown) has left bus bar 51. Numerals 48, 49, 50 and 51 respectively indicate each bus bar, numerals 52, 53 and 54 represent positive electrode plates and 55, 56 and 57 represent connectors.

This or similar configurations of apparatus forms a pattern of voltage application such as, for example, the one shown in FIG. 6. Voltage application is initiated in area B1, with a boosting pattern calling for boosting voltage rectilineally from zero to b or applying a specified low voltage throughout area B1, or a pattern of curved line (not shown). A specified voltage b is applied in area B2 and a specified higher voltage c is applied in area B3. In case there is a plurality of middle stage voltage application means, such as this embodiment, it is possible to apply a different voltage at a different stage. As a sufficient amount of under-coating film is formed in areas B1 and B2, it is possible to apply a large volume of current at high voltage in area B3, and, as a consequence, when an especially thick coating is desired, an electrodeposition film of the desired thickness can be obtained effectively and without trouble.

Operation of the present embodiment other than the aforementioned description corresponds to that of the First embodiment.

Although the above embodiments illustrate apparatus having a 3-stage and a 4-stage voltage applying means, a voltage applying means of more than four stages may be used as needed. Further, application of the present invention is not limited to cathodic electrodeposition coating, but also to other kinds of electrodeposition coating, such as, for example, anodic electrodeposition coating. The present invention is also applicable to workpieces other than vehicle parts, including vehicle bodies and other kinds of parts.

As hitherto described in detail such effects and merits as follows are obtained by electrodeposition coating according to the method of the present invention.

As voltage application is initiated after the workpieces to be coated enter the submersion area and is terminated before the workpieces leave the submersion area, the thickness of electrodeposition film on the workpieces is regularized so that there is no difference in film thickness between lower and higher workpieces or in the lower and upper parts of a workpiece. Further, by applying voltage in a plurality of stages, more specifically three or more stages of voltage applying means, it has become possible to do boosting, voltage application and termination of voltage application separately, and thus to giving identical voltage application factors to each and every continuously conveyed workpiece which is to be coated. Therefore, while simultaneously attaining even thickness of electrodeposition film regardless of the vertical location of workpieces as described above, it is possible to obtain a desired thickness of electrodeposition film.

Because of the uniform thickness of electrodeposition film, it also becomes possible to obtain a desirable thickness of the film coated onto the inside of a workpiece or thorough application of the electrodeposition onto the inside of the workpiece, while restraining the maximum thickness of the film coated onto the outside of the workpiece to a lower level in order to prevent looseness of bolts etc. Therefore, it is possible to control the amount of paint used to the minimum amount necessary, thus eliminating waste, by maintaining the minimum necessary thickness of film coated on the inside of workpiece and keeping down the thickness of film coated on the outside at the same time.

Further, as the voltage increase is initiated after the workpieces to be coated enter the submersion area, it is possible to prevent a sudden flow of a large amount of current and the resulting defects such as rashes and pinholes on the surface of film, and, thereby, improve quality of products.

Furthermore, as the generation of sparks at the beginning point and terminating point of current supply is prevented, it is possible to improve the life of the apparatus and also to reduce the cost of the repair and maintenance of the apparatus.

Although several preferred embodiments of the present invention have been described in detail, it will be appreciated by those skilled in the art that various modifications and alterations can be made to the particular embodiments shown without materially departing from the novel teachings and advantages of this invention. Accordingly, it is to be understood that all such modifications and alternations are included within the scope of the invention, provided they come within the scope of the appended claims and their equivalents.

What is claimed is:

1. A method of coating workpieces being continuously conveyed in succession through an electrodeposition bath having a submersion area of sufficient length in the direction of conveyance and depth to completely submerge a plurality of the successive workpieces and wherein a conveying means for each of the workpieces includes a conveyor carried electrode means for electrically coupling to a voltage applying means extending in the direction of conveyance, the voltage applying means having a plurality of stages including an entrance stage, an intermediate stage and an exit stage, each having an electrode with a predetermined length in the direction of conveyance for completing respective electrical circuits through corresponding submerged workpieces and the bath, said method comprising the steps of:

spacing the conveyor carried electrode means from each other a distance greater than the individual length of the electrode of the entrance stage and the electrode of the exit stage but less than the total length of the electrode of the intermediate stage;

coupling the conveyor carried electrode means for each spaced workpiece to the electrode of the entrance stage of the voltage applying means for completing a first circuit at times when each respective completely submerged workpiece enters the submersion area;

increasing the voltage in the first completed circuit from an initial value to a specified electrodeposition voltage for the electrodeposition of paint film while each submerged workpiece is being conveyed through an entrance area of the submersion area;

electrically connecting the entrance stage to the intermediate stage while the first circuit voltage is at said specified voltage;

electrically coupling the conveyor carried electrode means for each spaced workpiece to the electrode of the intermediate stage of the voltage applying means prior to electrically coupling the conveyor carried electrode means of each succeeding workpiece to the electro of the entrance stage, for completing a second circuit while each of the workpieces is being conveyed through an intermediate area of the submersion area;

electrically disconnecting the entrance stage from the intermediate stage and decreasing the voltage of the entrance stage of the voltage applying means to the initial value after the conveyor carried electrode means is electrically uncoupled from the entrance stage electrode and coupled to the electrode of the intermediate stage of the electrode voltage applying means;

electrically connecting the intermediate stage to the exit stage of the voltage applying means at times when the conveyor carried electrode means of each workpiece approaches an end of the intermediate stage in the direction of conveyance;

electrically coupling the conveyor carried electrode means of each spaced workpiece to the electrode of the exit stage of the voltage applying means for completing a third circuit while said second circuit is completed;

electrically disconnecting the exit stage from the intermediate stage after coupling of the conveyor carried electrode means of each workpiece to the electrode of the exit stage; and terminating the voltage in said third circuit while each respective workpiece is completely submerged in an exit area of the submersion area while the exit stage is electrically disconnected from the intermediate stage of the voltage applying means.

2. The method of claim 1, comprising the further step of equalizing the voltage in successive stages of the voltage applying means at times when the conveyor carried electrode means transfers from the electrode of one of said stages of the voltage applying means to a succeeding one of said stages of the voltage applying means.

3. The method of claim 1, further comprising sharing a common power source with the electrical circuits that include the intermediate stage and the exit stage, and wherein the step of terminating includes switching off the power source to the exit stage without terminating the voltage in the circuit including the intermediate stage prior to each workpiece leaving the exit area of the bath.

4. The method of claim 1, further comprising the step of conveying continuously said spaced workpieces at a substantially uniform rate through the submersion area.

5. The method of claim 4, wherein the step of conveying includes conveying a plurality of vertically and laterally spaced workpieces through the submersion area.

6. The method of claim 5, wherein the step of conveying includes suspending each plurality of vertically spaced workpieces from a hanger for continual conveyance through the submersion area.

7. A method according to claim 4, wherein the step of conveying includes conveying workpieces comprised of vehicle parts.

8. The method of claim 1, wherein the step of electrically coupling the conveyor carried electrode means to the electrode of the intermediate stage of the voltage applying means includes the substeps of coupling the conveyor carried electrode means successively to the electrodes of a plurality of voltage applying means for completing corresponding circuits prior to the step of electrically coupling the conveyor carried electrode means to the electrode of the exit stage of the voltage applying means.

9. The method of claim 8, wherein the substep of coupling includes supplying a different voltage to each of the plurality of voltage applying means.

10. A method according to claim 1, wherein each step of electrically coupling the conveyor carried electrode means to the electrode of a respective stage of the voltage applying means includes bringing a conductive member into physical engagement with a bus bar extending in the direction of conveyance.

* * * * *